US010463082B2

(12) United States Patent
Boele et al.

(10) Patent No.: US 10,463,082 B2
(45) Date of Patent: Nov. 5, 2019

(54) NEXT BEST NURSING BRA AND NURSER LINER

(71) Applicants: Alma Louise Boele, Fresno, CA (US); Paula Ann Manion, Gresham, OR (US)

(72) Inventors: Alma Louise Boele, Fresno, CA (US); Paula Ann Manion, Gresham, OR (US)

( * ) Notice: Subject to any disclaimer, the term of this patent is extended or adjusted under 35 U.S.C. 154(b) by 151 days.

(21) Appl. No.: 14/756,137

(22) Filed: Aug. 5, 2015

(65) Prior Publication Data

US 2016/0150834 A1 Jun. 2, 2016

Related U.S. Application Data

(60) Provisional application No. 62/123,807, filed on Nov. 29, 2014, provisional application No. 62/123,808, filed on Nov. 29, 2014.

(51) Int. Cl.

| | |
|---|---|
| ***A41C 3/00*** | (2006.01) |
| ***A41C 3/04*** | (2006.01) |
| ***A61J 9/06*** | (2006.01) |

(52) U.S. Cl.

CPC ..... *A41C 3/0035* (2013.01); *A41C 3/04* (2013.01); *A61J 9/0676* (2015.05)

(58) Field of Classification Search

CPC ..... A41C 3/04; A41C 3/0035; A41D 1/20; A41D 1/205; A41D 1/22; A61J 9/0676

USPC .... 450/36, 37, 38, 89; 604/75–79, 345–346; 215/11.1, 11.3; 248/102

See application file for complete search history.

(56) References Cited

U.S. PATENT DOCUMENTS

| | | | | |
|---|---|---|---|---|
| 2,679,048 A * | 5/1954 | Alberts | A41C 3/0021 2/104 |
| 3,289,874 A * | 12/1966 | Dailey | A61J 9/005 215/11.6 |
| 3,565,081 A * | 2/1971 | Barg | A41C 3/0035 450/30 |
| 4,193,506 A * | 3/1980 | Trindle | A61J 9/005 215/11.6 |
| 4,648,404 A * | 3/1987 | Clark | A41C 3/08 2/104 |
| 4,776,546 A | 10/1988 | Goldson | |

(Continued)

FOREIGN PATENT DOCUMENTS

WO WO2009/137223 A2 * 11/2009

*Primary Examiner* — Alissa J Tompkins
*Assistant Examiner* — Brieanna Szafran

(57) ABSTRACT

A nursing bra with nurser liner pouch for simulating breastfeeding. The bra includes multiple layers. The first outer layer can be opened and flipped down by releasing the clasp at the bra strap. The second inner layer with circular opening can be opened by (unfastening) the snaps (releasable fasteners) that attach the second inner layer to the back third layer. The second inner layer and back third layer create a pocket for the nurser liner pouch. The nurser liner pouch can contain fluid while the threaded cap base attached is sized to be secured to a commercially available nipple and retainer ring and can be placed into the pocket in the nursing bra with nipple protruding through the circular opening in the second inner layer. The nursing bra with nurser liner pouch is expected to far more closely simulate the experience and project the appearance of natural breastfeeding.

6 Claims, 8 Drawing Sheets

(56) References Cited

U.S. PATENT DOCUMENTS 4,965,888 A * 10/1990 Jones ..... A41D 1/205 2/104
5,086,517 A 2/1992 Jones
5,108,686 A 4/1992 Griffin
5,582,335 A 12/1996 Beard
5,690,679 A 11/1997 Prentiss
5,993,479 A 11/1999 Prentiss
D584,399 S * 1/2009 Pacini ..... D24/109
7,621,797 B1 11/2009 Hershkovich
8,307,463 B2 * 11/2012 Ritchie ..... A41C 3/04 2/104
8,397,926 B2 * 3/2013 Driver ..... A61J 9/001 215/11.1
8,523,629 B2 * 9/2013 Pundyk ..... A41C 3/0021 450/30
8,801,495 B1 * 8/2014 Guindon ..... A41C 3/105 450/36
2001/0019933 A1 * 9/2001 Wagner ..... A41C 3/0057 450/37
2003/0150890 A1 * 8/2003 Perricone ..... A61J 9/001 224/148.6
2008/0064299 A1 * 3/2008 La Fontaine ..... A41C 3/04 450/36
2008/0248718 A1 * 10/2008 Henke ..... A41C 3/04 450/38
2009/0166481 A1 7/2009 Chen
2009/0261054 A1 10/2009 Shelby
2011/0130072 A1 * 6/2011 Lander ..... A41C 3/0028 450/86
2013/0161280 A1 * 6/2013 Thalab ..... A61J 9/00 215/11.1
2014/0188199 A1 * 7/2014 Enderby ..... A61F 7/08 607/108
2014/0273737 A1 * 9/2014 Cortese ..... A41D 1/205 450/31

* cited by examiner

NEXT BEST NURSING BRA AND NURSER LINER

CROSS REFERENCE TO RELATED APPLICATIONS

This application claims benefit of my earlier filed U.S. Provisional Patent Applications Ser. No. 62/123,807 entitled "Next Best Nursing Bra", filed Nov. 29, 2014 and my U.S. Provisional Patent Application Ser. No. 62/123,808 entitled 'Next Best Nurser Liner', filed on Nov. 29, 2014.

BACKGROUND OF THE INVENTION

1. Field of the Invention

This invention relates to apparel worn by a women to simulate natural breastfeeding in the sensory experience provided to the baby and the mother. More specifically, the present invention relates to a nursing bra having an inner pocket between the inner front and back layers with a circular elasticized opening for holding a nurser liner pouch.

2. Description of Related Art

The prior art in the field of baby bottles, nipples and other nursing devices do not acknowledge nor resolve the physical limitations of mothers who want to experience the bonding breastfeeding brings and project the appearance of natural breastfeeding. The bonding process between a mother and baby serves as a foundation for an emotionally stable and physically secure individual. Scientific research indicates that such bonding begins immediately after birth during the feeding process, especially that of breastfeeding. Baby bottles require a mom to hold the bottle with one hand while cradling the baby with the opposite arm and hand. Breastfeeding and simulated breastfeeding allows a mother to use her free hand and arm to touch and caress her baby thus aiding in the bonding process.

Some have designed inventions in the prior art of nursing bras and infant feeding devices to overcome the mentioned shortcomings but all have failed for various reasons. For example, U.S. Pat. No. 4,776,546 is a bib like device designed for nursing an infant. The bib like device is made from a fabric and includes a mammary shaped area defining a pouch for retaining liquid. The pouch is designed to receive a container and communicates with an opening in the fabric for the nipple on the container to protrude. When worn by either parent the device is said to improve bonding between child and parent by anatomically simulating the female.

U.S. Pat. No. 5,582,335 suggest a nursing baby bottle holder for supporting a baby bottle with a sling that can be draped around the neck of the person feeding the baby.

U.S. Pat. No. 5,086,517 suggest a surrogate nursing bib together with a pouch and a container. The pouch is made of a latex material to give a natural looking background with snaps to secure to the bib. The bib has straps to secure to the neck and waist of the wearer. The container has a nipple and is placed in the pouch so that the nipple protrudes through the opening in the pouch.

U.S. Pat. No. 2009/0166,481 presents a device for simulating breastfeeding that is a bell shaped cup adapted to put on a human breast and a shoulder strap attached to two opposite positions on the cup. A nursing bottle is placed inside the bell shaped cup with it's nipple protruding out of the opening in the bell shaped cup to act like a breast for feeding a baby.

U.S. Pat. No. 5,108,686 suggest a device formed from a mold taken of a nursing mother's breast so that the shape exactly replicates the mothers nipple. This nipple then can be used to feed an infant when the mother cannot feed her infant or to allow a father or caregiver to feed the infant.

U.S. Pat. No. 5,993,479 suggest an infant feeding container that endeavors to imitate a female breast in form and function.

U.S. Pat. No. 5,690,679 suggest a container that is breast shaped that endeavors to simulate the feeling of a mothers breast.

U.S. Pat. No. 2009/0261054A1 suggest a infant feeding pouch that is a clear bag with two sections, a middle and two side wings. The middle oval section can contain fluid. When fluid enters the pouch it enlarges and when fluid exits it collapses. It is said to provide bonding through artificial breastfeeding.

Certainly, nursing brassieres, nursing devices and infant feeding containers are available for mothers to naturally breastfeed and to simulate breastfeeding. However the prior art has not developed significantly in providing a nursing bra with a nurser liner pouch such as this invention.

Accordingly, it is the general object of this invention to provide a nursing bra with a nurser liner pouch that when combined with a commercially available nipple and retainer ring will more closely simulate natural breastfeeding contributing to mother baby bonding.

Moreover, it is the object of this invention to provide a nursing bra and nurser liner pouch that when combined with a commercially available nipple and retainer ring will provide mothers emotionally and psychologically with the desired esthetic projected appearance of breastfeeding their babies.

BRIEF SUMMARY OF THE INVENTION

It is the object of the present invention to develop a nursing bra and nurser liner that will help simulate and project the appearance of natural breastfeeding thus aiding in the bonding between mother and baby. To achieve this the nursing bra and nurser liner have a number of features which will insure a significant improvement compared to previously developed designs.

The nursing bra of the present invention includes multiple layers; 1. An outer layer of a breast supporting, soft, padded and stretchable material. 2. An inner layer of a soft stretchable material with a center circular elasticized opening. 3. A back layer of a soft stretchable material.

In addition the inner layer with a circular elasticized opening creates a pocket with the back layer to hold the nurser liner pouch.

The nurser liner pouch of the present invention is of an oblate ellipsoid shape that is of a soft, pliable, transparent, silicone material with a rigid silicone pre-formed threaded cap base attached. The nurser liner pouch can contain 5.25 oz of fluid, is hand washable, re-usable and is designed so that a commercially available nipple with retainer ring can be secured to the preformed threaded cap base.

The primary advantage of the present invention is that of a nursing bra designed with an inner layer with a circular opening that forms a pocket with the back layer for a nurser liner pouch containing fluid secured to a commercially available nipple and retainer ring that can then be put into the inner and back layer pocket of the nursing bra. The attached nipple can then protrude through the circular elasticized opening in the inner layer for a mother to nurse her baby in the simulated art of breastfeeding.

Another advantage of the present invention is that the nurser liner will slowly deflate as the fluid is drawn out by the nursing baby. As the nurser liner deflates and pushes the fluid through the attached nipple it will eliminate air in the nurser liner and the babies stomach thus simulating an advantage of natural breastfeeding.

Still another advantage of the present invention is the mother and the baby can assume the natural breast feeding position with baby lying on the mothers arm with its face turned toward the mother's simulated nipple.

Yet another advantage of the present invention is the inner and back layer that forms a pocket in the nursing bra can also be used to hold a prosthesis once the nurser liner is removed.

Still another advantage of the present invention is that the nursing bra with nurser liner will aid mothers who may not be able to produce their own milk, mothers who have had a mastectomy of one or both breast, adoptive mothers or mothers who simply choose not to breastfeed to be able to simulate natural breastfeeding.

BRIEF DESCRIPTION OF THE DRAWINGS

The claims and many of the present inventions advantages of the nursing bra with nurser liner pouch will be more readily appreciated as this invention becomes better understood by reference to the following detailed descriptions and considered in conjunction with the accompanying drawings.

DETAILED DESCRIPTION OF THE INVENTION

In this description the nursing bra with nurser liner pouch refers to a bra and a nurser liner pouch which is specifically designed for a mother to simulate the art of breastfeeding. Reference is now made to the figures wherein like parts are referred to by like numerals throughout.

Figure 1:
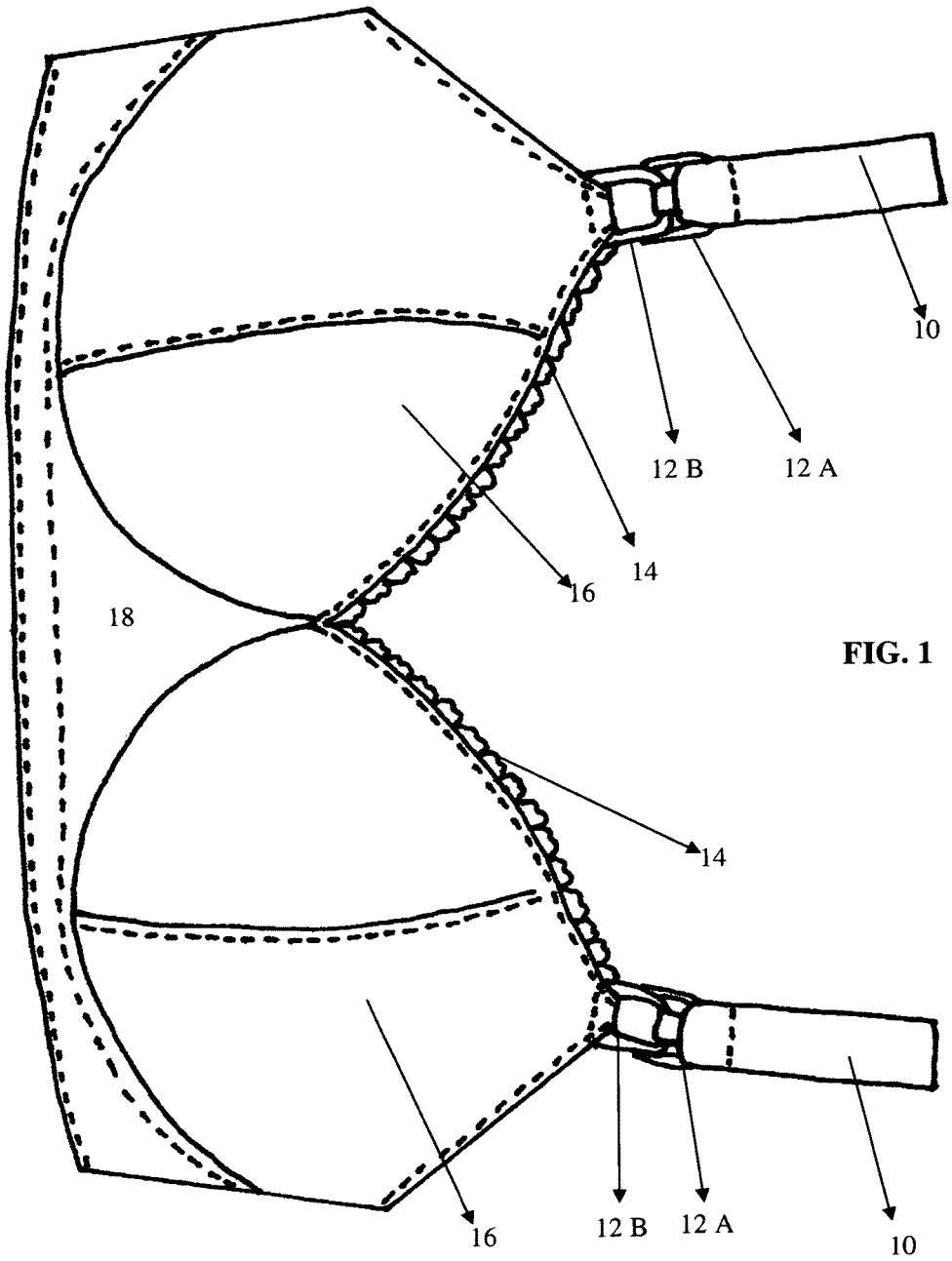
FIG. 1 is a front outer perspective view of the nursing bra for simulating breastfeeding according to an embodiment of the present invention.

FIG. 1 is a front outer perspective view of a preferred embodiment of the nursing bra according to the invention which is designated by the following reference numerals. 10 represents the shoulder straps of a stretchy elastic material. 12 represents the nursing bra clasp of a hard plastic material wherein the nursing bra clasp represent a two part clip. 12A of the nursing bra clasp is attached to the nursing bra strap 10. 12B of the nursing bra clasp is attached to the top of the front outer layer 16. 14 represents a soft lace material on the top edge of 16. 16 represents the front outer layer made of a breast supporting soft padded material. 18 represents the outer band of a soft stretchy material that is continuous and extends completely around the wearer.

Figure 2:
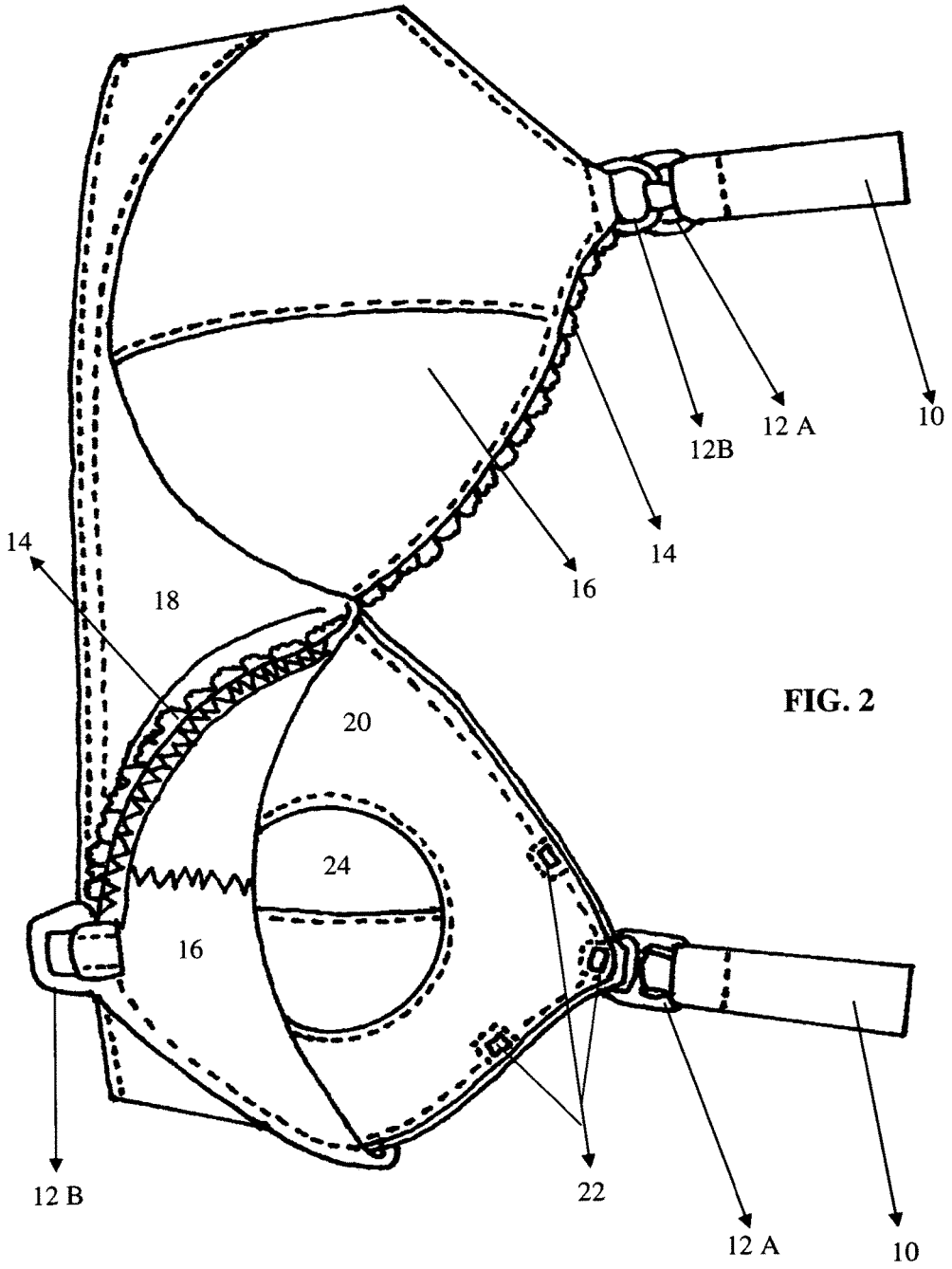
FIG. 2 is a front outer view of the nursing bra with the nursing bra clasp that attaches to the nursing bra strap opened and flipped down exposing the inside view of the front outer layer and the front view of the inner layer with circular opening according to an embodiment of the present invention.

FIG. 2 is the front prospective view of the nursing bra. 12A and 12B represent the nursing bra clasp in the open position revealing the inside view of the outer layer 16. 20 represents the front view of the inner layer made of a soft stretchy material with a circular opening made of a stretchy elasticized material. 22 represents snaps (releasable fasteners) made of a hard plastic material that secures the inner layer 20 to the back layer 24. 24 represents the front view of the back layer made of a soft stretchy material that completely covers the wearers breast or chest area preventing exposure of the wearers natural breast or chest and can be seen through the circular opening in 20.

Figure 3:
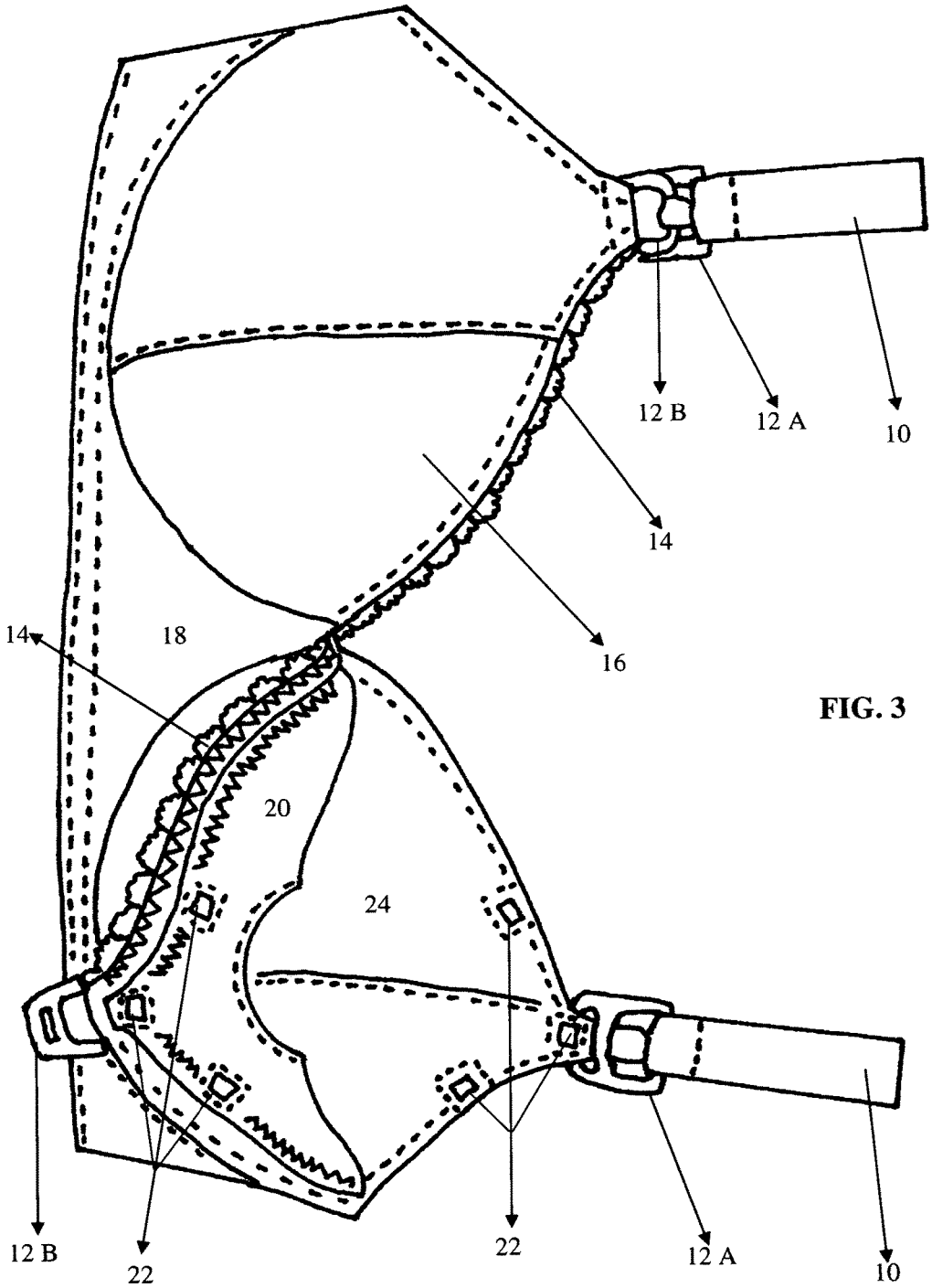
FIG. 3 is a front outer view of the nursing bra with the inner layer unsnapped (unfastened) and flipped down exposing an inside view of the inner layer and the front view of the back layer according to an embodiment of the present invention.

FIG. 3 reveals the back view of layer 20 with snaps (releasable fasteners) 22 unsnapped (unfastened) and the inner layer 20 in the flipped down position. 24 reveals the front view of the back layer that covers the wearer's breast or chest area.

Figure 4:
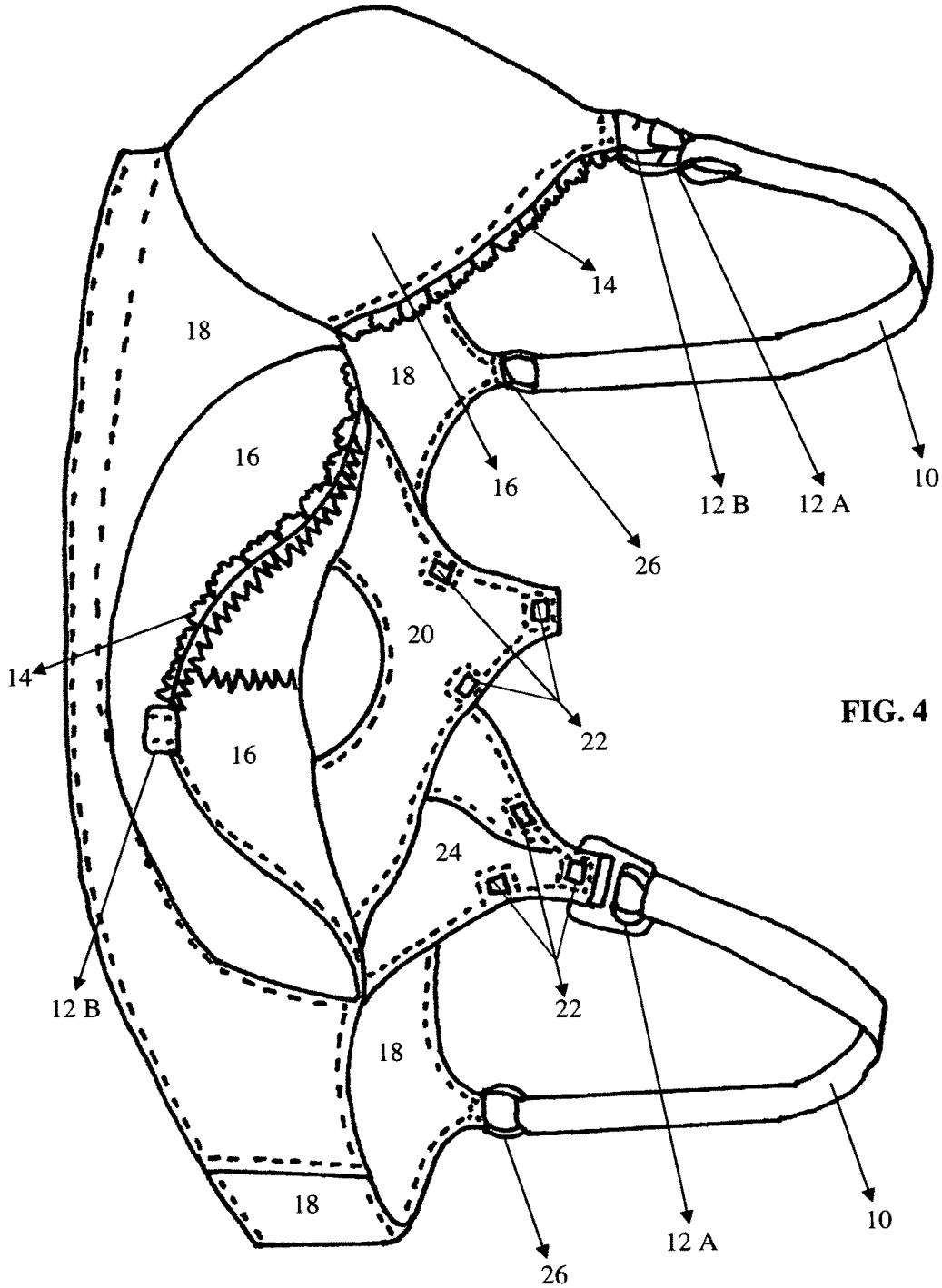
FIG. 4 presents all layers of the nursing bra in their opened position according to an embodiment of the present invention.

FIG. 4 is a prospective view of the nursing bra of the present invention revealing layers 16 and 20 in the open position while exposing the front of the back layer 24. The inner layer 20 with the circular opening and the back layer 24 that creates a pocket for the nurser liner pouch with a commercially available nipple and retainer ring attached to be placed inside. (Nurser liner pouch with commercially available nipple and retainer attached not shown in FIG. 4)

Figure 5:
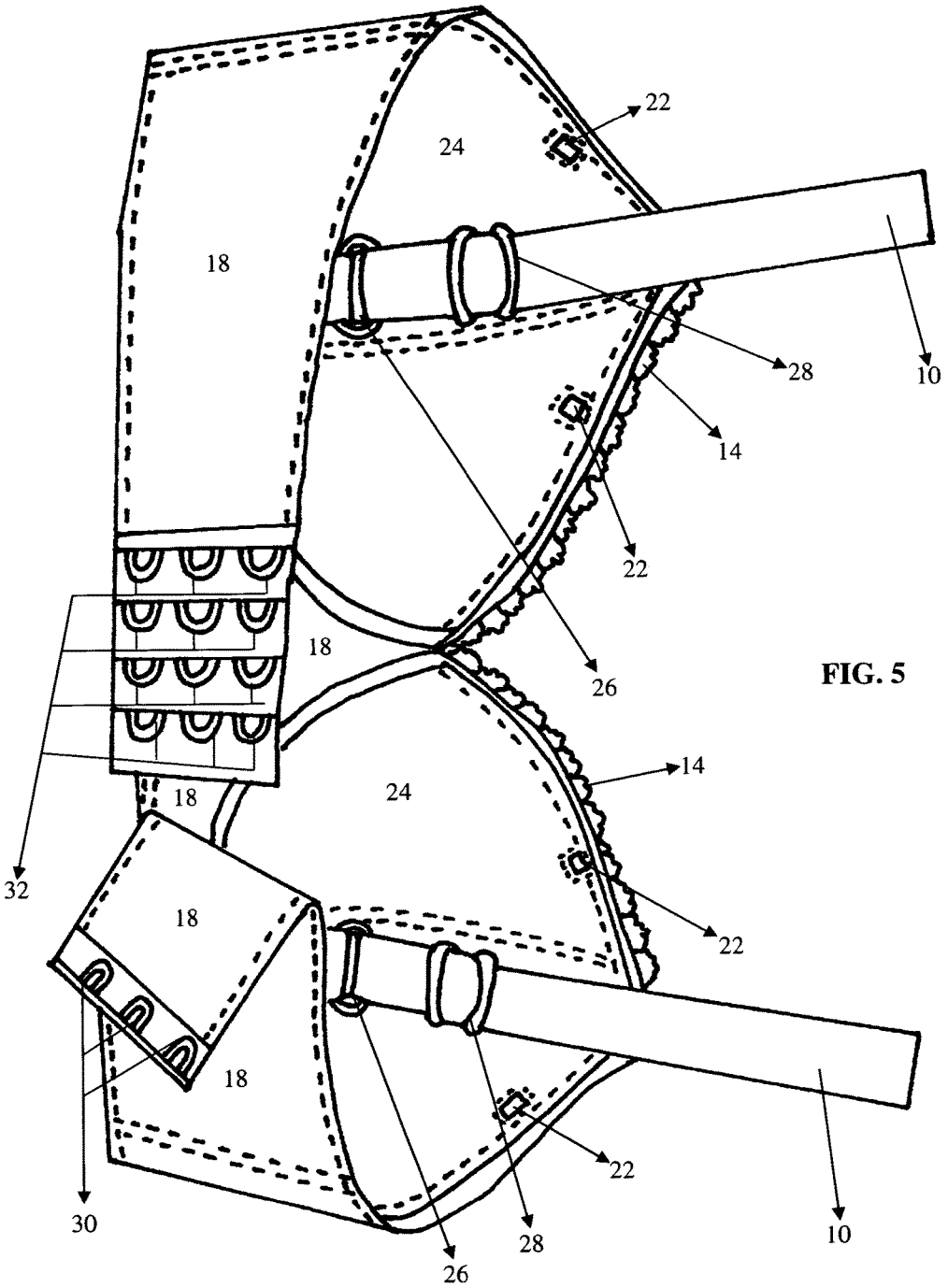
FIG. 5 presents the back view of the nursing bra revealing an adjustable hook and eye closure according to an embodiment of the present invention.

FIG. 5 represents the back view of the nursing bra of the present invention. 26 represents the hard plastic circular bra ring that attaches to the bra strap 10. 28 represents the hard plastic bra strap slide adjuster so that the wearer can comfortably adjust the nursing bra straps 10 to their individual comfort level. 30 represents the hook and 32 represents the eye closure made of a metal wire material that will bring both sides of the outer band 18 together. This hook 30 and eye 32 closure will allow the wearer to adjust the nursing bra to four different positions around the wearer's chest under their breast area to their individual comfort level.

Figure 6:
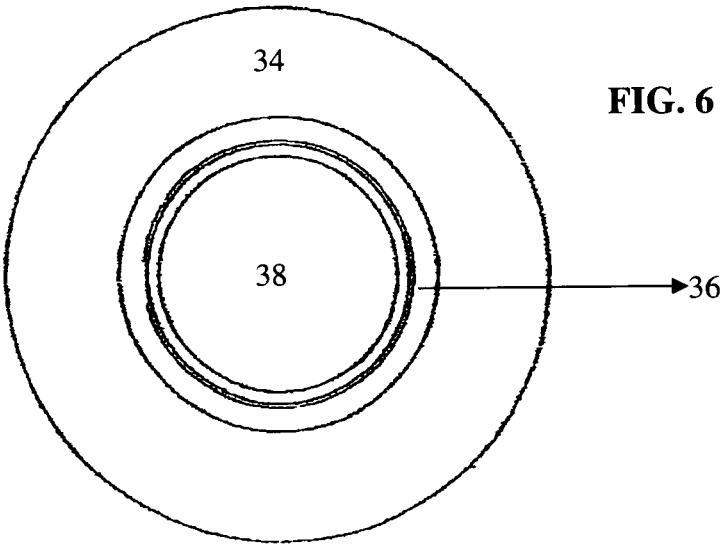
FIG. 6 presents a front elevation plan view of the nurser liner pouch according to an embodiment of the present invention.
Figure 7:
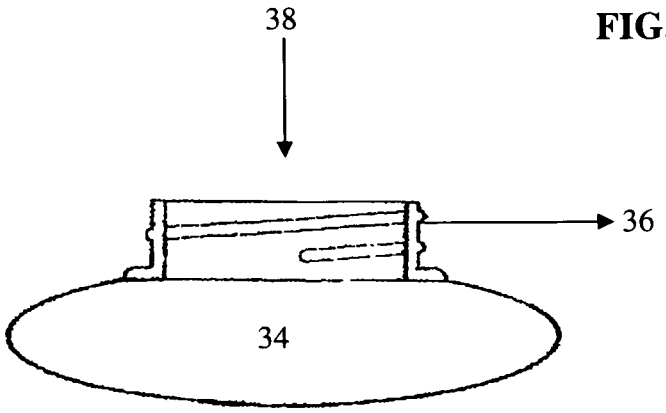
FIG. 7 presents a side section view of the nurser liner pouch according to an embodiment of the present invention.

FIGS. 6 and 7 is a prospective view of a nurser liner pouch. 34 represents an oblate ellipsoid shape. 36 represents a pre-formed threaded cap base. 38 represents the circular opening in the pre-formed threaded cap base that serves as a filling port for fluid into the nurser liner pouch.

Referring to FIGS. 6 and 7, the nurser liner pouch of the present invention is preferably constructed of a soft pliable non-disposable reusable transparent silicone food grade material at the nurser liner pouch 34 and will be sealed to the pre-formed threaded cap base 36, preferably constructed of a rigid transparent silicone food grade material.

By referring to the drawings of FIGS. 6 and 7 it can be seen that the pre-formed threaded cap base 36 is of a suitable size for a select commercially available nipple with retainer ring attached. (commercially available nipple with retainer ring not shown)

In regards to FIGS. 6 and 7 the nurser liner pouch 34 has the capacity of 5.25 oz. of fluid.

FIGS. 6 and 7 illustrate a nurser liner pouch that will be integrated into the nursing bra as a removable part.

Figure 8:
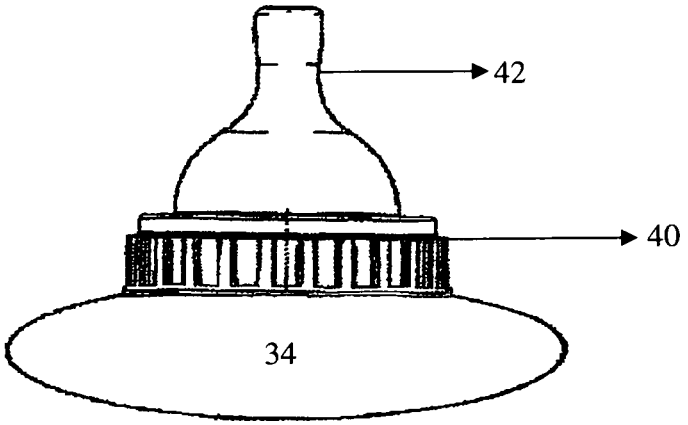
FIG. 8 presents a side view of the nurser liner pouch with a commercially available nipple and retainer ring attached.

FIG. 8 represents a side view of the nurser liner pouch 34 with a commercially available nipple 42 and retainer ring 40.

Figure 9:
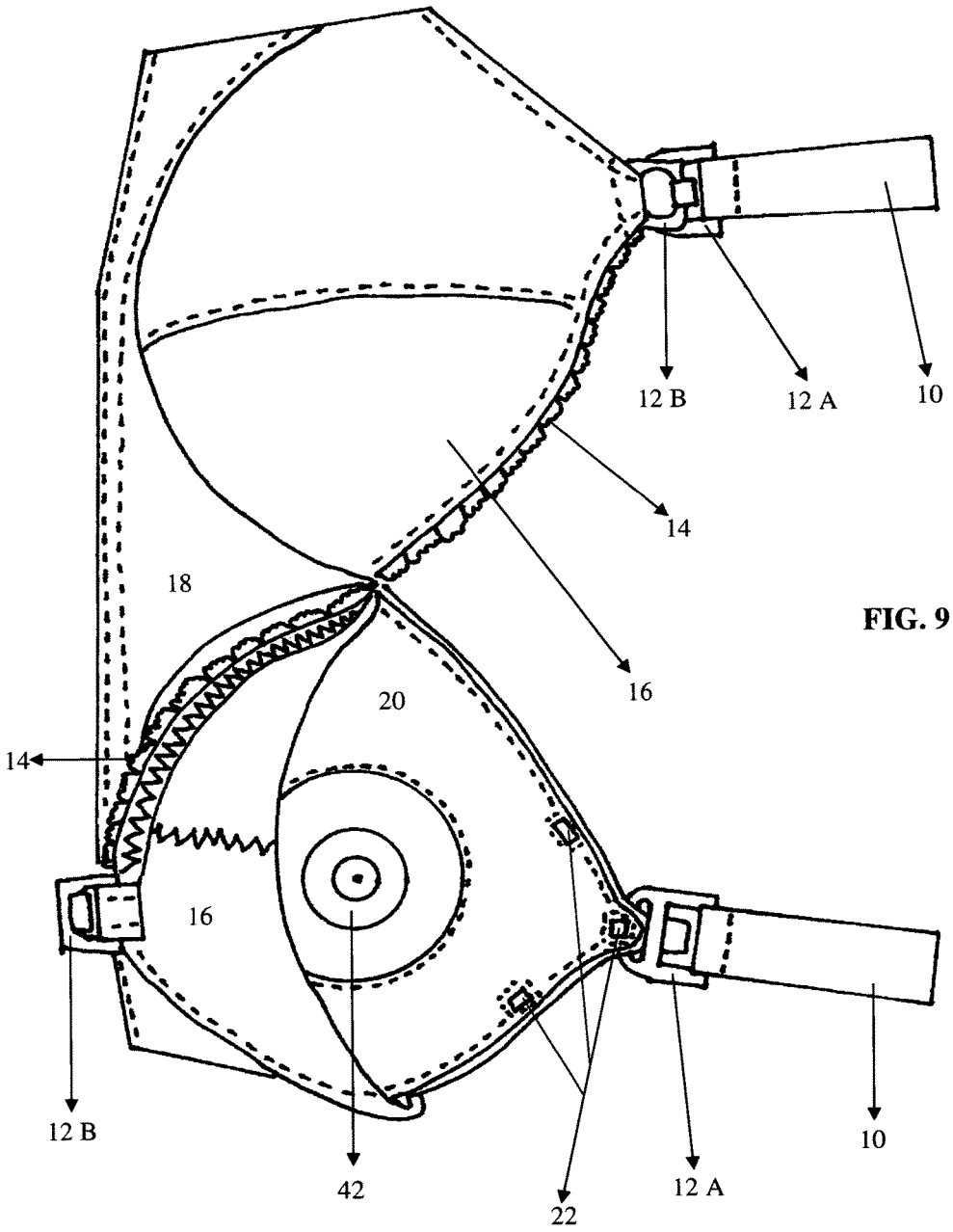
FIG. 9 reveals the nursing bra with the front outer layer open and flipped down exposing the nipple protruding through the circular opening in the inner layer according to an embodiment of the present invention.

FIG. 9 reveals the nursing bra of the present inventions front outer layer 16 with the two part clasp 12A and 12B unclasped and flipped down. The inner layer snaps (releasable fasteners) 22 have been snapped (fastened) closed over the nurser liner pouch (nurser liner pouch not visible) securing the inner layer 20 to the back layer 24 (back layer 24 not visible) with the nipple 42 protruding through the circular elasticized opening in the inner layer 20.

From the foregoing description it can be seen that a nursing bra with a nurser liner pouch designed to simulate and project the appearance of natural breastfeeding has been described in terms of the preferred embodiment. It should be noted that the drawings are not drawn to scale and that various changes and modifications may be made without departing from the scope of the present invention.

Having described the embodiments of the invention what is claimed is defined as follows:

1. A nursing bra configured to simulate and project the appearance of natural breastfeeding, wherein the nursing bra comprises:

three separate layers; the three separate layers comprising:
an outer layer,
an inner layer and
a back layer,
wherein the inner layer being positioned between the outer layer and the back layer, wherein the outer layer overlapping the inner layer and the inner layer overlapping the back layer such that the inner layer and the back layer form a pocket for holding a nurser liner pouch configured to contain liquid;

wherein the outer layer comprises a material with a first portion of a two part clasp attaching the outer layer to a bra strap;

a second portion of the two part clasp coupling the bra strap to the back layer, wherein the first portion of the two part clasp is configured to removably connect to the second portion of the two part clasp thereby allowing the outer layer to be folded down when the two part clasp is unfastened;

wherein the inner layer comprises a material with an opening in the inner layer such that a portion of the nurser liner pouch is accessible when the two part clasp is unfastened and the outer layer is folded down from the two part clasp;

wherein the inner layer comprises at least one snap that is capable of releasably fastening to the back layer of said nursing bra;

wherein the back layer comprises a material that is configured to completely cover at least one of a wearer's breast;

wherein during use:
the outer layer of the three separate layers is unclasped from the second portion of the two part clasp attached to the bra strap;
the inner layer of the three separate layers is fastened to the back layer with the at least one snap with the nurser liner pouch located between the inner layer and the back layer; and the outer layer is folded down exposing a portion of the nurser liner pouch, whereby the nursing bra, holding the nurser liner pouch, is configured to simulate natural breastfeeding without exposing the at least one of the wearer's breast.

2. The nursing bra according to claim 1, wherein the first and second portions of the two part clasp are configured to be unclasped such that the outer layer is capable of being opened and folded down on said nursing bra.

3. The nursing bra according to claim 1 wherein the at least one snap on the inner layer is configured to be unfastened such that the inner layer is capable of being opened and folded down on said nursing bra.

4. The nursing bra according to claim 3, wherein the nurser liner pouch comprises a circular threaded top portion having a rim with a circular opening and a oblate ellipsoid shaped bottom portion; wherein the circular top threaded portion comprises a rigid food grade material;

wherein the oblate ellipsoid shaped bottom portion comprises a pliable food grade material; wherein the circular threaded top portion is sealed to the oblate ellipsoid shaped bottom portion of said nurser liner pouch.

5. The nursing bra according to claim 4, wherein the nurser liner pouch further comprises a circular threaded top portion and a retainer ring whereby the retainer ring is configured to securely join a nipple to said nurser liner pouch.

6. The nursing bra according to claim 5 wherein the nipple protrudes through the opening in the inner layer; wherein the inner layer is configured to be closed over the nurser liner pouch by fastening the inner layer and the back layer with the at least one snap.

* * * * *